US005255653A

United States Patent [19]

Ironside et al.

[11] Patent Number: 5,255,653

[45] Date of Patent: Oct. 26, 1993

[54] ENGINE THROTTLE CONTROL SYSTEM

[75] Inventors: John M. Ironside; Peter M. Fox, both of Birmingham; Alistair M. McQueen, West Midlands; David R. Price, Birmingham, all of England

[73] Assignee: Lucas Industries Public Limited Company, Solihull, England

[21] Appl. No.: 31,755

[22] Filed: Mar. 15, 1993

Related U.S. Application Data

[62] Division of Ser. No. 775,643, Oct. 10, 1991, Pat. No. 5,193,506, which is a division of Ser. No. 509,111, Apr. 13, 1990, Pat. No. 5,074,267.

[30] Foreign Application Priority Data

Apr. 17, 1989 [GB] United Kingdom ..... 8908661

[51] Int. Cl.[5] ..... F02D 41/22

[52] U.S. Cl. ..... 123/399; 123/198 D

[58] Field of Search ..... 123/198 D, 361, 399, 123/479

[56] References Cited

U.S. PATENT DOCUMENTS

| | | | |
|---|---|---|---|
| 4,612,615 | 9/1986 | Murakami | 123/399 X |
| 4,909,213 | 3/1990 | Mezger et al. | 123/399 X |
| 5,150,681 | 9/1992 | Kull et al. | 123/399 |

*Primary Examiner*—Tony M. Argenbright
*Attorney, Agent, or Firm*—Jenner & Block

[57] ABSTRACT

An engine throttle control system comprises a control unit for controlling the position of a throttle by means of a motor in response to a position transducer actuated by an accelerator pedal. A detector detects when a signal produced by the control system is outside a range of acceptable values and, for instance, shuts down the engine. In one embodiment, the detector detects whether power supplied to the motor is less than a value expected on the basis of the position and speed of movement derived from the output of a throttle position sensor.

2 Claims, 10 Drawing Sheets

ENGINE THROTTLE CONTROL SYSTEM

This is a division of application Ser. No. 07/775,643, filed on Oct. 10, 1991, now U.S. Pat. No. 5,193,506, which is a division of application Ser. No. 07/509,111 filed on Apr. 13, 1990, now U.S. Pat. No. 5,074,267.

BACKGROUND OF THE INVENTION

The present invention relates to an engine throttle control system, for instance for use in controlling an internal combustion engine for driving a vehicle.

Throttle control systems for controlling petrol and diesel engines for vehicles include the so-called "drive by wire" system in which there is no mechanical linkage between a driver actuated accelerator pedal or cruise control command switch and a mixture controlling system, such as one or more carburetors or a fuel injection system. Systems of this type also lend themselves readily to automatic traction control functions for preventing wheel spin during heavy acceleration and/or in conditions of poor ground adhesion. However, special requirements are placed on the performance and safety of such systems, which must function reliably and in accordance with various design parameters at all times.

Drive by wire systems are governed by various regulations which, among other things, specify how such systems should perform in the event of a component failure. Thus, U.S. Federal Law requires that there shall be at least two sources of energy capable of returning a throttle to its idle position within a specified time limit from any accelerator position or speed whenever a driver removes the opposing actuating force. Further, in the event of a failure of one source of energy, the throttle is required to return to the idle position within the specified time limit. Other conditions and situations may require a different "fail safe" or "fail soft" action, for instance merely warning the driver of a failure in one of the system channels but allowing at least limited drivability so that a vehicle does not become stranded but can be driven to a garage for repair.

Servo control systems for engine throttles have been devised to provide a desirable accelerator pedal sensation with good isolation from engine vibration and to facilitate trimming of the response of the engine to the accelerator pedal. Such systems allow additional features to be incorporated, such as vehicle speed control and traction control, since throttle positioning in all modes of operation can be controlled by a single actuator and position controller. Vehicle acceleration disturbances and mechanical complexity associated with, for instance, changeover from accelerator pedal command to cruise control can be minimized.

If a system of this type were to fail such that a throttle was driven open against the wishes of a driver, an accident might be caused A known system for providing fail safe operation uses a brushed motor driving a throttle against a return spring through a reduction gear box. This system is fitted to a car which has two separate inlet manifolds, each with its own throttle, servo system, and fuel and ignition control If a control system failure is detected, then the fuelling and ignition can be disabled on the associated manifold and the driver can be warned. The vehicle can then proceed at reduced power.

A mechanism of this type with a brushed motor and a reduction gear box requires a return spring which is capable of closing the throttle against a short circuited motor within a specified time limit. The motor itself provides a second source of energy for closing the throttle to the idle position. However, there can be problems with the reliability of this type of mechanism for use in an engine with a single inlet manifold, because a relatively small piece of foreign matter, such as a fragment of a motor brush, could jam the motor or gear box. This would prevent closure by the relatively low powered motor or return spring, which latter would have to work through a disadvantageous gear ratio. Accordingly, direct drive mechanisms have been devised using brushless torque motors sufficiently powerful to open the throttle against friction forces and the return spring without any gearing.

Although coincident failures arising from independent causes are unlikely, it is possible, in a system having two sources for returning the throttle to the idle position, for a failure in one to lie dormant and undiscovered for a long period, possibly until a failure occurs in the other system. Thus, if both systems failed in this way, it could become impossible to close the throttle and there would be serious risk of an accident or mechanical damage, for instance caused by over-revving of the engine.

In such systems, it is possible for a servo control loop to become unstable, for instance because a mismatch arises between the element being controlled and parameters of an associated controller. It is also possible that faults in command signals or elsewhere, or the ingress of foreign matter, could lead to the throttle actuator being driven hard against an end stop for its movement, or against an obstruction. Again, this could produce driving behavior of the vehicle likely to cause an accident or mechanical damage to the vehicle.

In such systems, the angular position of the throttle is normally derived from measurement of the accelerator pedal position. It is possible to provide two return springs acting on the accelerator pedal so as to urge it towards the idle position. The accelerator pedal is actuated by the foot of a driver against these spring forces, and it is possible that a driver would not notice if one spring were to weaken or break or become disconnected. The failure might only become apparent when the other spring failed, again leading to loss of control of the engine throttle. It is further possible that a failure may occur giving rise to the accelerator pedal position detector sending a signal to a control unit representing a pedal depression in excess of that demanded by the driver, but less than a maximum legitimate pedal depression.

In such systems where the throttle motor provides one source for closing the throttle and normally acts against the bias of a return spring tending to return the throttle to the idle position, the throttle closing action of the motor may not be regularly tested in the absence of a failure, since this function is performed by the return spring. Thus, a failure in the part of the system responsible for causing the motor to close the throttle may lie dormant and only become apparent should the return spring fail. If the components responsible for causing the motor to close the throttle were to be energized during normal engine operation with a normally operating return spring, the throttle would close very quickly and this might stop the engine, cause a noticeable disturbance to the control of the vehicle, or cause damage immediately or over a period of time.

SUMMARY OF THE INVENTION

According to the invention, there is provided an engine throttle control system for controlling a motor for actuating an engine throttle, comprising means for detecting when a signal of the control system is outside a range of acceptable values.

In a first embodiment of the invention, there is provided an engine throttle control system, comprising a throttle for controlling engine output, a throttle return spring, a motor for actuating the throttle against the action of the return spring, and means for detecting when the power supplied to the motor is less than an expected value.

The system is thus capable of detecting breakage of the return spring because the power supplied to the motor is less than that normally required to overcome the action of the spring. The detecting means may provide an indication of spring failure to a vehicle driver, for instance by controlling illumination of a warning light. Additionally, or alternatively, the detecting means may be arranged to cause the engine to operate in a predetermined condition, for instance by closing the throttle so as to shut down the engine or return it to an idling condition. The detecting means may alternatively or additionally shut down the engine by removing a source of ignition or fuel supply or by blocking an exhaust path.

The motor and throttle may be part of a servo system for controlling throttle opening, for instance comprising a control unit receiving signals from a position sensor representing throttle opening and supplying power to the motor so as to move the throttle to a desired position. In the case of a vehicle, the desired position may be determined by a further position sensor actuated by an accelerator pedal.

The expected value may be a constant value or a function of the position and/or velocity of the throttle.

The motor may be an electric motor, a pneumatic motor, a hydraulic motor or any other suitable motor.

In a second embodiment of the invention, there is provided an engine throttle control system, comprising a servo control loop for controlling the throttle and producing an error signal representing a difference between a demanded throttle parameter and an actual throttle parameter, a non-linear function generator for receiving the error signal, a low pass filter for filtering the output of the function generator, and means for detecting when the output signal of the filter exceeds a maximum expected level.

The throttle parameter is preferably throttle position.

The system is thus capable of detecting when the servo control loop becomes unstable or when the system drives the throttle hard against an end stop or obstruction, since the servo error signal is such as to cause the filter output signal to exceed the maximum expected level. Small errors which occur during normal servo operation and large transient errors which may occur following large sudden changes in demand are ignored, however.

The detecting means may provide an indication or shut down the engine using any of the techniques described hereinbefore.

The non-linear function generator preferably has a rectifying and variable gain transfer function In one embodiment, the function generator rectifies and clips the error signal so that error signals smaller than a limit value are ignored. In another embodiment, the function generator squares the error signals so as to reduce the effect of small error signals relative to larger ones.

The pass-band or turnover frequency of the filter is preferably chosen such that the effects of larger errors of short duration do not persist too long in the filter, but persistent errors of medium or large size quickly cause the filter output signal to exceed the maximum expected level.

The maximum expected level may be a constant value or a function of a demanded throttle parameter. For instance, the maximum expected level may be calculated as a function of the magnitude of the velocity or rate of change of the demanded throttle position, preferably subjected to low-pass filtering. This allows a higher level of error to be tolerated when rapid movement is demanded, and thus improves discrimination between normal errors in following rapid movement and serious control failures.

In a third embodiment of the invention, there is provided an engine throttle control system comprising a servo control loop for controlling a throttle motor and detecting means for detecting when power supplied to the motor exceeds a maximum expected value.

It is thus possible to detect a condition in which a motor is driving the throttle hard against an end stop or obstruction. For instance, if the power exceeds the maximum expected level for the opening or closing direction of the throttle, the engine may be shut down using any of the non-throttle techniques described hereinbefore. In a preferred embodiment, the servo control loop includes a number of parallel control elements, such as proportional, integral, and differential, whose outputs are summed to provide a motor drive signal. The output of the integral control element is preferably compared with the maximum expected value by the further detection means. The integral element output provides the quickest indication of an obstructed motor while being relatively unaffected by transient errors.

During a journey, it is possible, for thermal changes and other causes to alter the position of either or both end stops of the mechanical range of throttle movement The servo loop thus could drive the throttle against an altered end stop while trying to respond to a valid demand signal, and the integral element output could exceed the maximum expected value, causing the engine to be shut down In order to avoid this, preferably there are provided means for comparing the integral element output with an opening and/or closing hard limit value and means responsive to the hard limit value being exceeded and the throttle position being within a predetermined wide-open or closed recalibration range for a predetermined number of times, such as twenty, for recalibrating a wide open or closed reference value. After the recalibration has been performed, preferably the integral element is reset to a nominal wide-open or closed value, for instance predetermined so as just to meet return spring forces at the wide-open or closed position of the throttle. This avoids or reduces delays in re-establishing control when a demand signal becomes less extreme.

In a fourth embodiment of the invention, there is provided an engine throttle control system comprising an accelerator pedal, at least one accelerator pedal return spring, a sensor responsive to the stress in the at least one return spring, and detection means for detecting when the stress sensed by the sensor is less than an expected stress value.

The detection means may provide an indication or shut down the engine using any of the techniques described hereinbefore.

The expected stress value may be a constant value or may be a function of the position and/or velocity of the pedal.

It is thus possible to detect a weakened or broken return spring which might not otherwise be detected by a driver, so as to allow a repair to be made before complete failure of the accelerator pedal return spring. It is also possible to detect errors in a pedal position transducer which would otherwise cause acceleration demand to exceed the required demand e.g. if the transducer were to supply a signal representing a pedal depression greater than that imposed by a driver but less than the maximum legitimate pedal depression.

The sensor is preferably mounted between the at least one return spring and an anchorage to which the pedal is attached, but may be mounted elsewhere, for instance between the at least one return spring and the pedal or on an actuating face of the pedal.

In an embodiment where, under normal operation, the stress and pedal position are related by a predictable monotonic function of pedal position, the signal from a pedal position transducer may be supplied to a characteristic function generator having a transfer function representing the function and providing the expected stress value. In another such embodiment, the signal from the sensor may be supplied to a characteristic function generator having a transfer function representing the function, preferably including hysteresis. The output of the function generator may then be compared with the pedal position by the detection means. If the output of the function generator is smaller than the pedal position but larger than the expected stress value, the function generator output may be used for controlling throttle position instead of the pedal position signal.

In a fifth embodiment of the invention, there is provided an engine throttle control system comprising a throttle, a motor for driving the throttle, a throttle return spring, a throttle position transducer, means for causing the motor to open the throttle after the engine has stopped, means for subsequently causing the motor to close the throttle, and means for assessing the closing response of the throttle.

The throttle opening means may be arranged to open the throttle following a predetermined delay after the engine has stopped. The throttle closing means may be arranged then to supply maximum closing power to the motor for a predetermined period, at the end of which the throttle position detected by transducer may be compared with predetermined limit values for acceptability. For instance, these limit values may be selected so as to discriminate between the throttle being closed by both the return spring and the motor, and by the return spring alone. The motor may subsequently be briefly energized in the throttle opening direction so as to slow the rapidly closing throttle and avoid too violent an impact with a stop.

Thus, any failure in components responsible for driving the motor in the closing direction can be detected when the engine has stopped and the engine can be prevented from being started until the fault has been remedied.

The transducer output with the throttle wide open may be compared with limit values for acceptability and, if acceptable, used as a new wide-open throttle reference position. The system can thus adapt to small changes, for instance caused by aging or temperature drift.

The system allows the throttle closing function to be regularly tested so that a fault cannot lie dormant until, for instance, a return spring fails and the throttle remains open. Also, by checking the wide-open throttle position periodically, the system can ensure that throttle position commands are mapped onto the actual mechanical working range of the throttle.

In a sixth embodiment of the invention, there is provided an engine throttle control system comprising a throttle, a motor arranged to actuate the throttle, a drive circuit for driving a winding of the motor, and an additional drive circuit for driving an additional electrically independent winding of the motor.

Preferably the system further comprises a throttle return spring, a throttle position sensor, and a first control unit for controlling the motor via the drive circuit.

There may be more than one additional drive circuit, each associated with a respective additional electrically independent motor winding. The or each additional drive circuit is preferably provided with a respective independent additional control unit. Preferably the or each additional control unit is arranged to provide open loop control of the motor. This avoids conflicts when the first control unit provides closed loop motor control.

Preferably the additional winding is periodically driven in a throttle closing direction and the control action produced by the first control unit to maintain the throttle at a commanded angle is compared with an expected action to verify the ability of the additional control unit to force the throttle in the closing direction. Preferably the additional winding is periodically driven harder than usual in a throttle opening direction and the control action produced by the first control unit to maintain the commanded throttle angle is compared with another expected action to verify the ability of the first control unit to force the throttle in the closing direction.

In the case of a system using a direct drive motor for throttle actuation, the risk of failure caused by gear box seizure is eliminated. By providing redundancy in the form of duplication or multiplication of motor windings and associated drive arrangements, the reliability of the system is increased. The system can be periodically tested, even while a vehicle is being driven, to ensure that the system is working correctly and, if not, a warning can be given and/or the engine shut down as described hereinbefore.

BRIEF DESCRIPTION OF THE DRAWINGS

The invention will be further described, by way of example, with reference to the accompanying drawings, in which.

DESCRIPTION OF THE PREFERRED EMBODIMENTS

Figure 1:
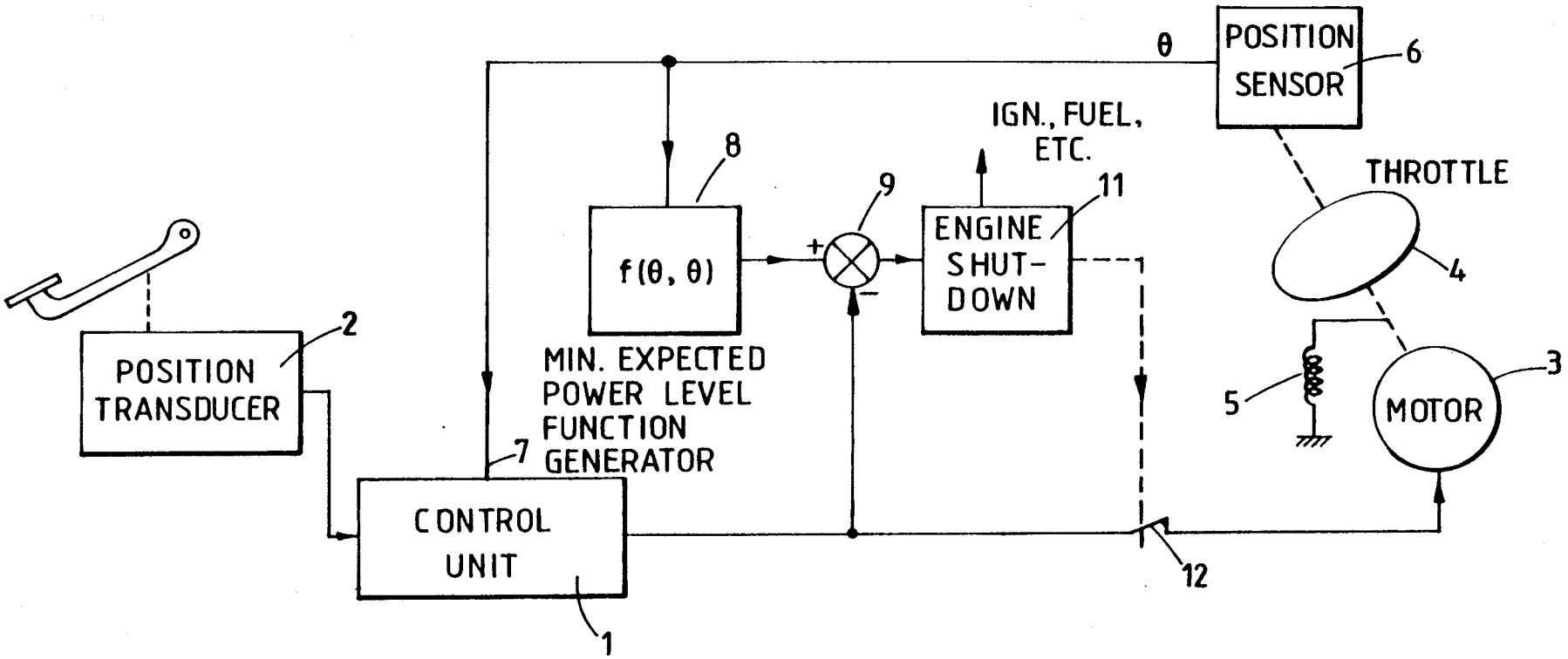
FIG. 1 is a schematic block diagram of an engine throttle control system constituting a first embodiment of the invention.

The system shown in FIG. 1 comprises a control unit 1 which receives from an accelerator pedal position transducer 2 a required throttle position or demand signal. The control unit 1 has an output for driving a brushless DC motor 3 which directly actuates a butterfly or throttle 4 of an internal combustion engine carburetor or fuel injection system. The throttle 4 is provided with a return spring 5 which urges the throttle towards a closed position or an idle position. The throttle 4 is connected to a position sensor 6 which supplies a signal 8 representing the actual angular position of the throttle 4, this signal being supplied to a feedback input 7 of the control unit 1.

The throttle position signal 8 is also supplied to the input of a function generator 8 which produces an output signal, as a function of throttle position and speed of angular movement, which represents the minimum expected power level of power supplied to the motor 3. The output of the function generator 8 is supplied to a subtracter 9, which forms the difference between this signal and the power actually supplied by the control unit 1 to the motor 3. The output of the subtracter 9 is supplied to an engine shut down circuit 11 which sends signals to ignition and fuelling control circuits for returning the engine to idle operation. The circuit 11 also controls a switch contact 12 for disconnecting the control unit 1 from the motor 3.

The system thus monitors the power supplied to the motor 3, which power is related to the return force exerted by the return spring 5. The power supplied to the motor 3 is determined mainly by the torque which the motor has to produce in order to overcome the action of the return spring 5 in driving the throttle 4 to the demanded position. The minimum power required for any particular position and angular speed of the throttle 4 is calculated in the function generator 8 and, if the motor power is less than the minimum expected power, action is taken. Thus, if the return spring 5 weakens, breaks, or becomes detached, the reduced return torque is associated with a reduction in power supplied to the motor 3. This condition is detected and appropriate action taken. In the embodiment shown, the various engine control systems cause the engine to be shut down or returned to idle operation. Alternatively or additionally, a warning indication may be given to a driver of a vehicle in which the engine is installed. Thus, if the engine is not disabled, it is possible for the driver to return the vehicle to his home or to a garage for suitable remedial action. A further possible action is to restrict the maximum opening of the throttle 4 so as to limit engine power and hence maximum speed of the vehicle until a repair is made.

Figure 2:
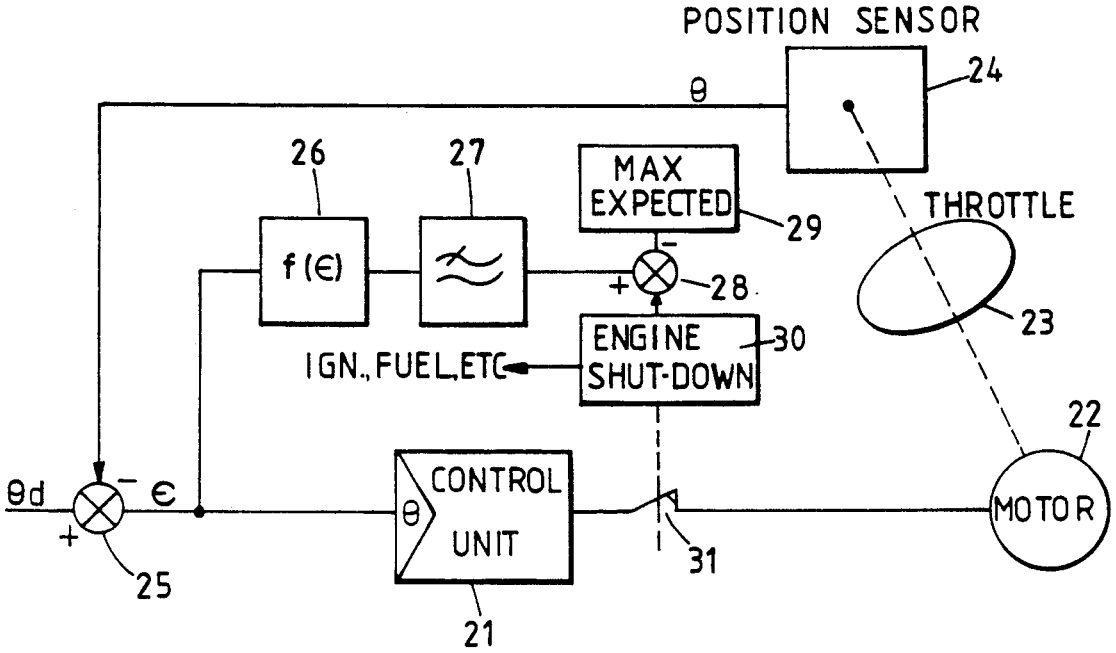
FIG. 2 is a block schematic diagram of an engine throttle control system constituting a second embodiment of the invention.

The system shown in FIG. 2 comprises a throttle servo control in which a control unit 21 controls a brushless motor 22 which directly drives a butterfly or throttle 23 of an engine carburetor or fuel injection system. A position sensor 24 is connected to the throttle 23 and provides a throttle angular position feedback signal $\theta$. A subtracter 25 forms the difference between a throttle position demand signal $\theta d$ and the feedback signal $\theta$ to produce an error signal $\epsilon$ which is supplied as input to the control unit 21.

The error signal is also supplied to a non-linear function generator 26 whose output is supplied to a low pass filter 27. A subtracter 28 subtracts a maximum expected value signal provided by circuit 29 from the output of the filter 27 and controls an engine shut down circuit 30 in response to the difference signal. The circuit 30 controls a contact 31 and ignition and fuelling control circuits of the engine in the same way as the circuit 11 in FIG. 1.

The system of FIG. 2 thus monitors the error signal $\epsilon$ and, if this signal exceeds certain parameters indicating a fault in the servo control loop, the engine is shut down or placed in some other predetermined operational state as described hereinbefore.

The non-linear function generator 26 performs a function on the error signal such as to ignore larger errors which occur briefly in response to large sudden changes in demand and caused by the inevitable delay in response of the servo control loop to such sudden large changes, for instance in the demand signal $\theta d$. Also, very small errors which can in any case arise during normal operation are ignored by the non-linear function. This is to prevent the effects of static friction, noise, and normal servo error from triggering the circuit 30. The turnover frequency of the low pass filter 27 is chosen so as to prevent transient signals which occur during normal operation from triggering the circuit 30. However, persistent errors of medium or large size quickly cause the circuit 30 to be triggered so as to shut down the engine or take other appropriate action, as such errors indicate instability or failure in the servo control loop, sticking or obstructions of the throttle 23, for instance caused by the ingress of foreign matter, or demand signals $\theta d$ outside a permitted or expected range.

The system shown in FIG. 2 may be provided independently of the system shown in FIG. 1. Alternatively, the systems of FIGS. 1 and 2 may be combined, in which case the control unit 21 and the subtracter 25 form part of the control unit 1 and the motor 22, the butterfly 23, the sensor 24, the circuit 30 and the contact 31 correspond to the parts 3, 4, 6, 11, and 12, respectively, in FIG. 1.

Figure 3:
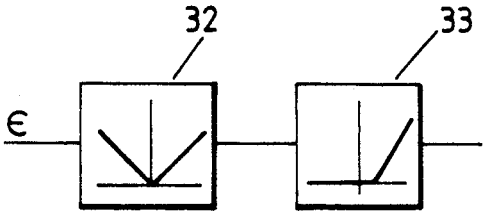
FIGS. 3 to 7 are block schematic diagrams showing possible additions and modifications to the second embodiment.

One type of non-linear function generator 26 is illustrated in FIG. 3 and comprises a rectifier circuit 32 followed by a variable gain circuit 33 which is illustrated as providing a "dead-band" so as to ignore relatively low amplitude signals and pass only relatively high amplitude signals with a suitable gain.

Figure 4:
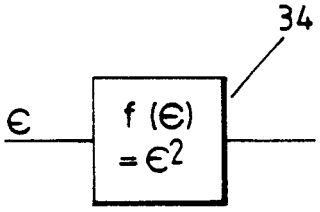

FIG. 4 shows another type of function generator in the form of a squaring circuit 34. Such a "parabolic" function has the effect of reducing the effect of small error signals while emphasizing the effect of larger error signals.

Figure 5:
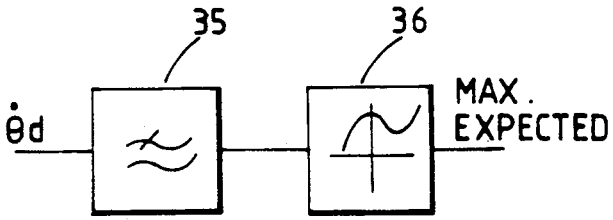

FIG. 5 shows a possible form for the maximum expected error signal circuit 29. Although in some embodiments it may be sufficient to provide a constant level signal as the maximum expected signal, the arrangement shown in FIG. 5 calculates the maximum expected level as a function of the magnitude of the rate of change of the demand signal θd and low pass filtering. In particular, the rate of change of the signal θd is supplied to low pass filter 35 whose output is supplied to a function generator 36. Thus, the maximum expected signal is raised when rapid throttle movement has been demanded, which demand will lead to larger error signals ε as the servo control loop catches up, temporarily reducing the sensitivity of the circuit 30 to avoid erroneous detection of faults.

Figure 6:
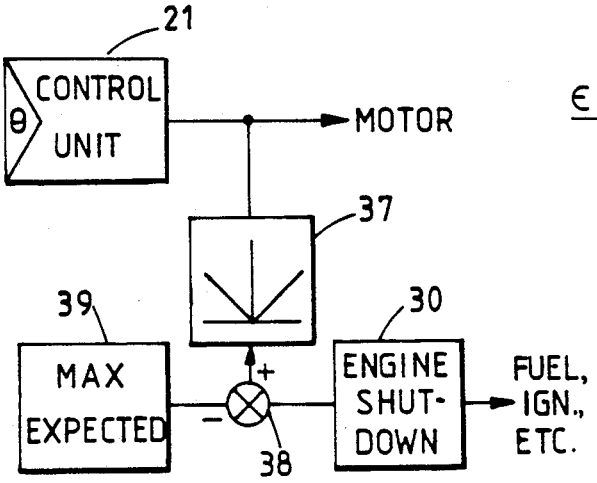

FIG. 6 shows an arrangement for detecting when the motor 22 is being driven hard against an end stop or obstruction. A rectifier 37 rectifies the output of the control unit 21 and compares this in a comparator or subtracter 38 with a maximum expected value from a circuit 39. When the maximum expected value is exceeded, indicating excessive power supplied to the motor, the circuit 30 shuts down the engine or takes other appropriate action as described hereinbefore.

Figure 7:
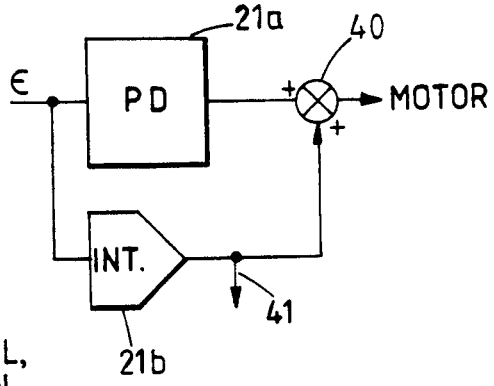

The control unit 21 may comprise a number of parallel control elements, such as proportional, integral, and differential elements, the outputs of which are summed to provide the drive signal or power to the motor. FIG. 7 shows such an arrangement in which the control unit 21 has been shown schematically as comprising a first unit 21*a* for the non-integral terms and a second unit 21*b* for an integral term, the outputs of the units being summed by a summer 40. The input to the rectifier 37 is taken from the output of the integral part 21*b* at 41 as this output gives the quickest reliable indication of an obstructed motor and is relatively unaffected by transient errors.

Figure 8:
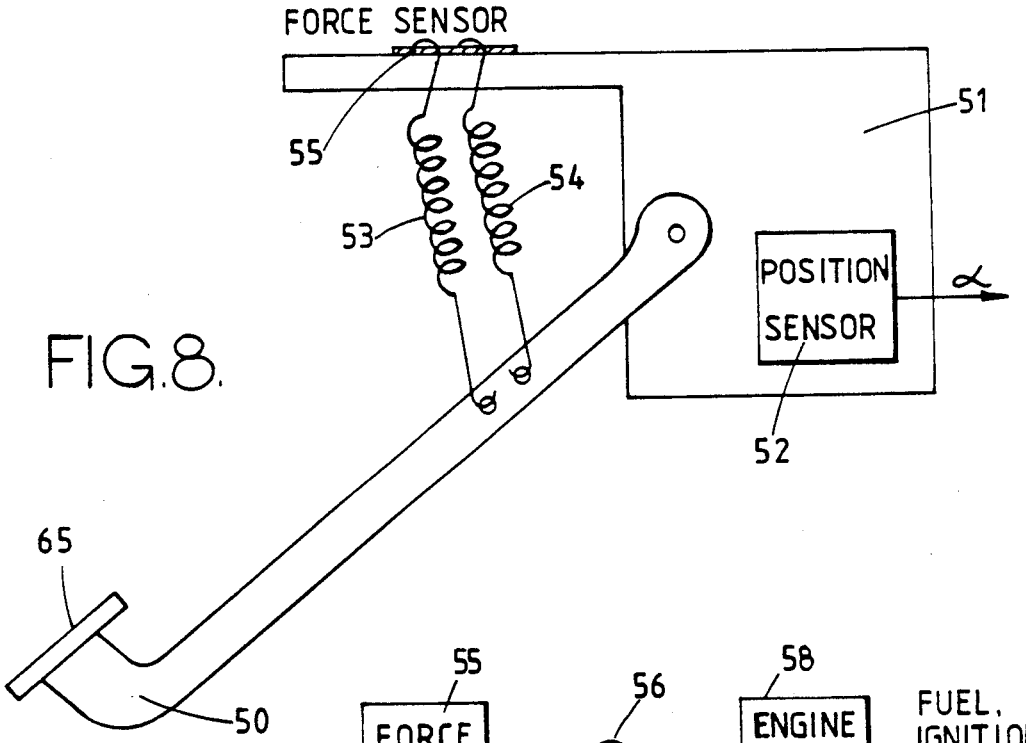
FIG. 8 is a diagram of an accelerator pedal arrangement.

In FIG. 8, an accelerator pedal 50 is pivotally mounted to a mounting 51 fixed to the vehicle The pedal 50 is connected to a position sensor 52 (corresponding to 2 in FIG. 1) whose output provides a signal α representing the position of the pedal. A pair of return springs 53 and 54 are each connected at one end to the pedal 50 and at the other end to a force sensor 55 mounted on the mounting 51. The force sensor 55 supplies a signal representing the total of the stresses in the springs 53 and 54.

Figure 9:
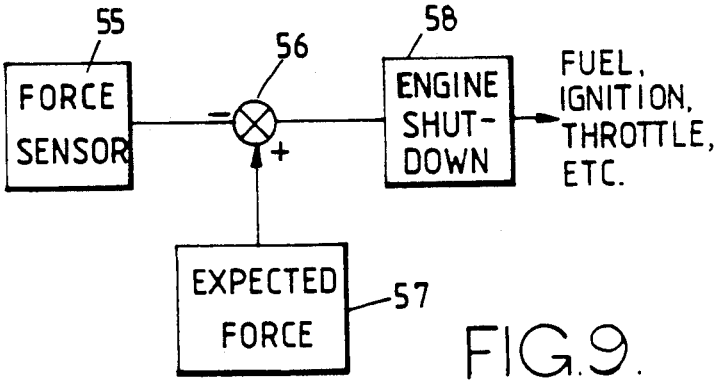
FIGS. 9 to 11 are block schematic diagrams of circuits for use with the arrangement of FIG. 8 to form a set of third embodiments of the invention.

FIG. 9 shows the force sensor 55 connected to an input of a comparator or subtracter 56 whose other input is connected to an expected force circuit 57. The output of the comparator 56 is connected to an engine shut down circuit 58 corresponding to 11 in FIG. 1 and 30 in FIG. 2 for shutting down the engine or taking any other appropriate action.

The force sensor 55 monitors the total stress in the springs 53 and 54 and this is compared in the comparator 56 with the expected force from the circuit 57. If the sensed force differs from the expected force and, in particular, is less than the expected force, then the engine is shut down or returned to some other predetermined operating state. Such a difference is indicative of weakening, a breakage, or disconnection of one or both of the springs 53 and 54. For instance, if one spring fails, appropriate action is taken even though the failure may not be detected by a driver.

Figure 10:
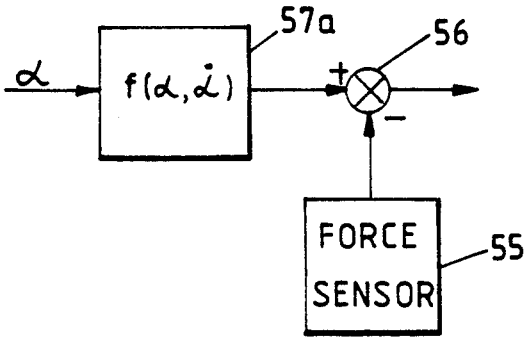

The expected force circuit 57 may provide an expected force signal of constant value However, FIG. 10 shows an expected force circuit 57*a* which produces an expected force signal as a function of the position and rate of change of position of the accelerator pedal 50, the circuit being connected to the output of the position sensor 52. Such an arrangement provides more accurate detection of failure or imminent failure in cases where, under normal operation, the stress in the springs 53 and 54 is a predictable and monotonic function of accelerator position and/or speed of movement. The characteristic function of the expected force circuit 74*a* represents the response of a normal set of return springs.

Figure 11:
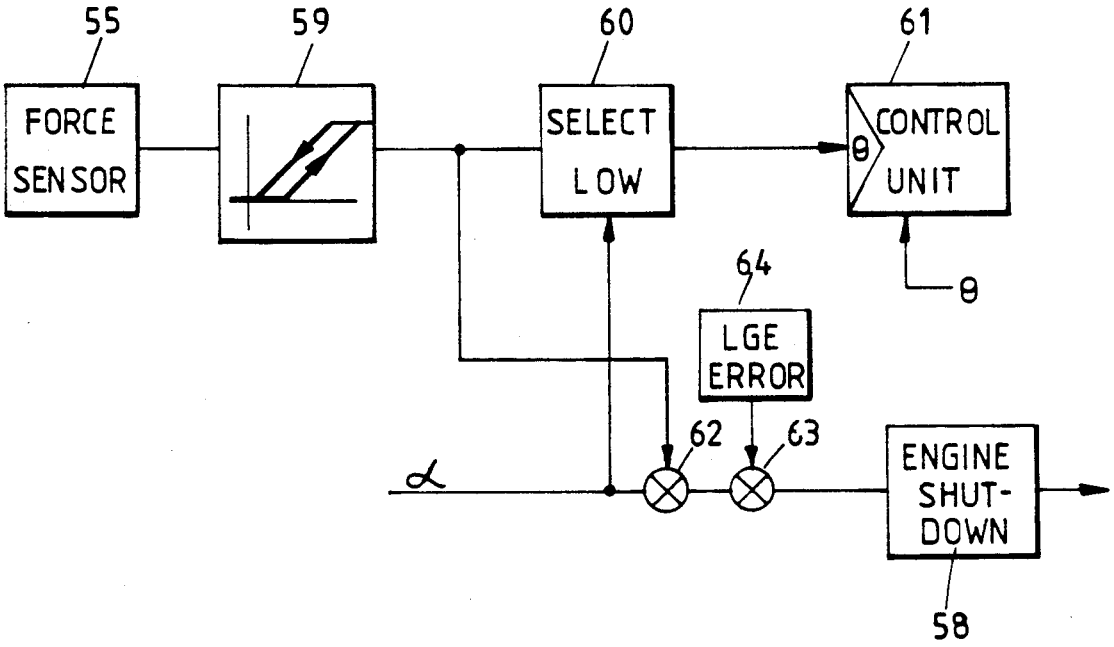

FIG. 11 shows a further refinement, in which the output of the force sensor 55 is supplied to a characteristic function generator 59 having a hysteresis function. The output of the generator 59 and the signal c are supplied to a select low circuit 60, which selects the lower of the two signals and supplies this as a throttle command signal to a control unit 61, which receives a feedback throttle position signal 8 and controls a motor for actuating the throttle. The control unit 61 corresponds to 1 in FIG. 1.

The function generator 59 has a characteristic function which converts the force signal from the sensor 55 into a signal representing the position of the accelerator pedal 50 and this is compared with the position sensor signal α in a comparator 62. The difference between these signals is supplied by the comparator 62 to a further comparator 63 which compares the difference with a maximum expected error signal supplied by a circuit 64 and causes the engine shut down circuit 58 to shut down the engine as described hereinbefore if the difference exceeds the maximum expected error signal.

The force sensor 55 is shown as being located between the mounting 51 and the springs 53 and 54. However, it could also be located between the springs 53 and 54 and the accelerator pedal 50. Another possibility is that the sensor 55 could be located at the actuating face 65 of the accelerator pedal 50 in order to respond to the actuating force imposed by a driver.

Figure 12:
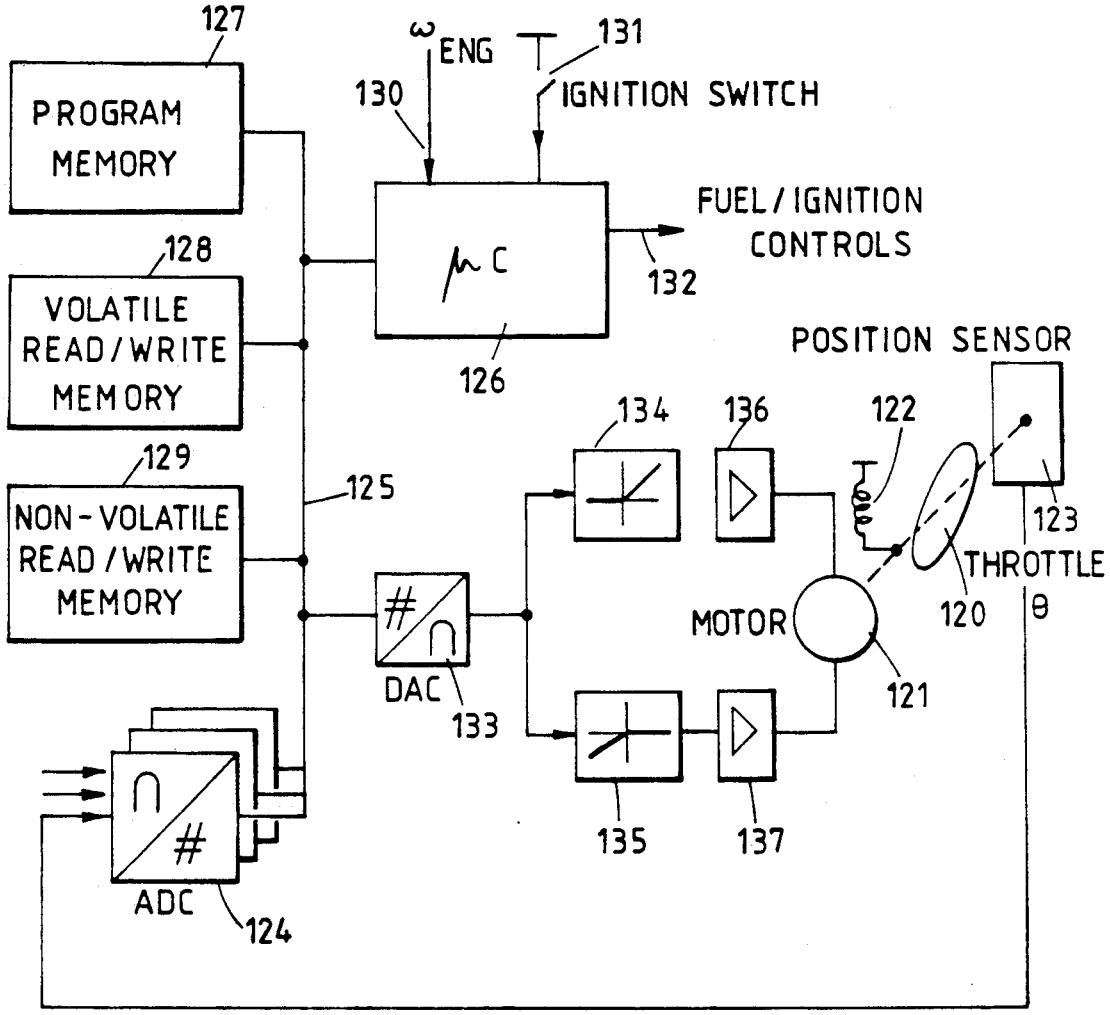
FIG. 12 is a block schematic diagram of an engine throttle control system constituting a fifth embodiment of the invention.

FIG. 12 illustrates a microcomputer-based embodiment suitable for performing the functions of the systems described above and for performing additional functions as will be described below. This embodiment comprises a butterfly throttle 120 driven by a motor 121 and provided with a return spring 122. The throttle 120 is connected to a throttle angular position transducer 123 whose output provides a signal θ representing the throttle opening angle to the input of an analog/digital converter 124. The parts 120, 121, 122, and 123 correspond to the parts 4, 3, 5, and 6, respectively, of FIG. 1. The converter 124 is one of several such converters (indicated diagrammatically in FIG. 12) for receiving other signals, such as a throttle position demand signal.

The converter 124 is connected to a bus 125 which is connected to a micro-computer 126 including a microprocessor, a program memory 127 in the form of a read-only memory, a volatile read/write (random access) memory 128, and a non-volatile read/write memory 129. The bus 125 carries addresses, data, and control signals for all of the devices connected thereto. The program or software for controlling the micro-computer 126 is stored in the memory 127. The memory 128 acts as a working or "scratch pad" memory for storing data used during operation of the system but not requiring permanent storage. Memory 129 provides storage of, for instance, operating parameters and updating of such parameters, which are required during future operation of the system irrespective of whether the system is switched off or the power supply disconnected in the interim.

The micro-computer 126 has an input 130 connected to receive a signal $w_{eng}$ from an engine speed sensor (not shown) to allow the system to determine when the engine has stopped rotating. The micro-computer 126 has another input connected to an ignition switch 131 of the vehicle. Finally, the micro-computer 126 has outputs 132 for controlling other internal combustion engine systems, such as ignition timing and various aspects of fuel supply to the engine.

A digital/analog converter 133 is connected to the bus 125 and has an analog output connected to a half-wave rectifier 134 for passing only positive signals and to a half-wave rectifier 135 for passing only negative signals. The outputs of the rectifiers 134 and 135 are connected to the inputs of motor drive amplifiers 136 and 137, respectively, whose outputs are connected to the motor 121.

Figure 13A:
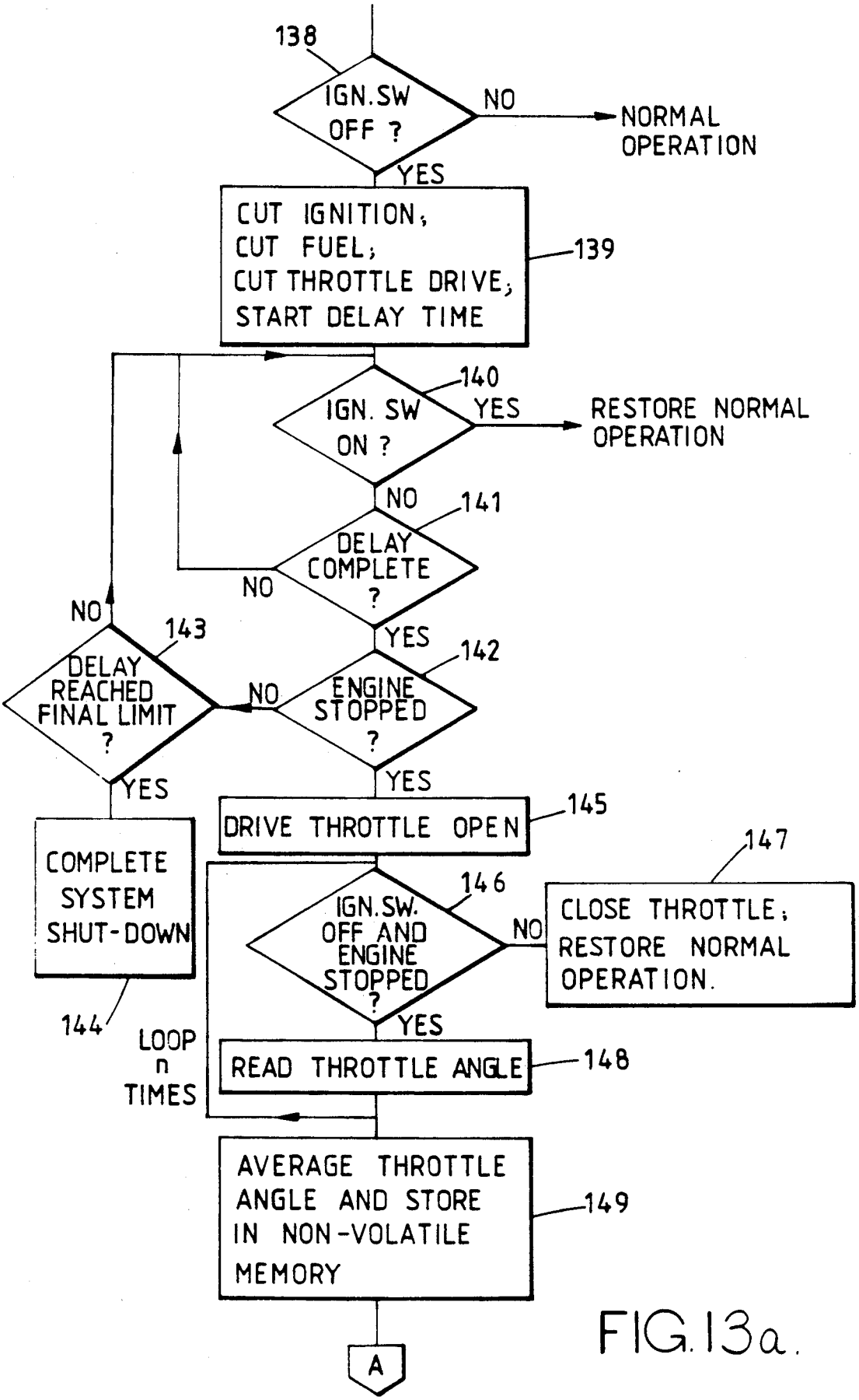
FIGS. 13*a* and 13*b* constitute a flow chart for illustrating operation of the embodiment of FIG. 12.
Figure 13B:
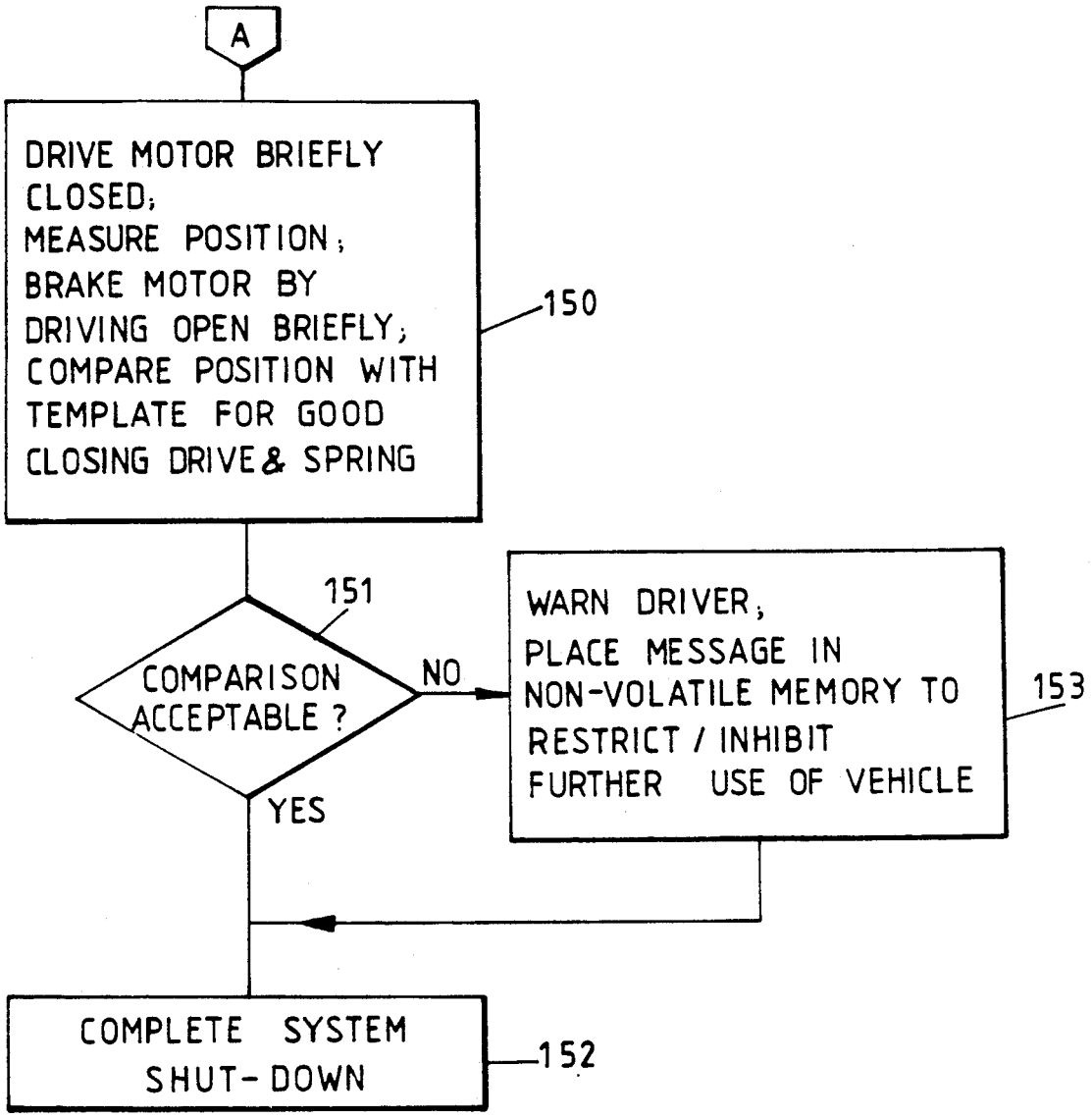

FIGS. 13*a* and 13*b* show a flow chart for part of the software contained in the memory 127 for controlling the micro-computer 126 when the engine is turned off. The micro-computer 126 periodically checks at 138 whether the ignition switch is off and, if not, continues with normal driving operation. When the ignition switch 131 is detected as having been switched off, the micro-computer 126 switches off the ignition, fuel, and throttle drive signals and begins a short delay time at 139. At 140, the micro-computer checks whether the ignition switch has been turned on and, if so restores normal operation. If not, the micro-computer checks at 141 whether the delay time has expired and loops back to 140 until it has. The micro-computer then checks at 142 whether the engine has stopped and, if not, checks whether a final delay limit has been reached at 143. If not, control is again returned to 140. If the final limit has been reached, and the engine is still rotating, the micro-computer 126 initiates a complete system shut down at 144 because a fault condition has been detected.

If the engine has stopped, the micro-computer supplies a signal via the converter 133, the rectifier 134, and the amplifier 136 to cause the throttle 120 to be driven fully in the open direction (145). The micro-computer again checks at 146 whether the ignition switch is off and the engine has stopped and, if not closes the throttle immediately and restores normal operation at 147. If the ignition switch is off and the engine stopped, the micro-computer reads at 148 the throttle angle for the fully opened throttle 120 supplied by the position sensor 123 via the converter 124. This measurement is repeated n times and then the average of the throttle angle values obtained is taken and stored in the non-volatile memory 129 at 149.

At 150, the micro-computer supplies a signal via the converter 133, the rectifier 135, and the amplifier 137 for causing the motor 121 to be driven for a short period in a direction such as to close the throttle 120. At the end of this period, the throttle position is again measured, after which the motor 121 is briefly driven in a throttle opening direction so as to slow the speed of closing of the throttle 120 in order to reduce wear and prevent damage which might otherwise occur if the throttle 120 were to hit the closed end stop at too high a speed. The measured position of the throttle is compared with a "template" or range of acceptable values for a properly working return spring 122 and control system. If the comparison indicates that the system is working correctly (151), the system is shut down at 152 and no further action is taken. However, if the comparison indicates that the measured throttle position is outside the template, the micro-computer 126 provides a warning for a driver (153) and stores in the non-volatile memory 129 a message for restricting or inhibiting further use of the vehicle until a repair has been made. The complete system shut down 152 is then performed.

Thus, if there is any failure or parameter drift in the return spring 122 or in the motor 121 and associated electronics for causing the motor to close the throttle 120, the driver is warned and further use of the vehicle prevented or restricted until a repair has been made. The template used for comparison in the step 150 represents a range of values for the throttle position after it has been driven in the closing direction for the preset period which are acceptable and encompass normal tolerances and drifts when both the spring 122 and the motor 121 and associated electronics are working correctly to close the throttle Also, any drift in the measured throttle angle for full throttle opening is detected and corrected for in the step 149. Although not used for checking correct closing of the throttle, this value is used by other aspects of the engine throttle control system.

Figure 14:
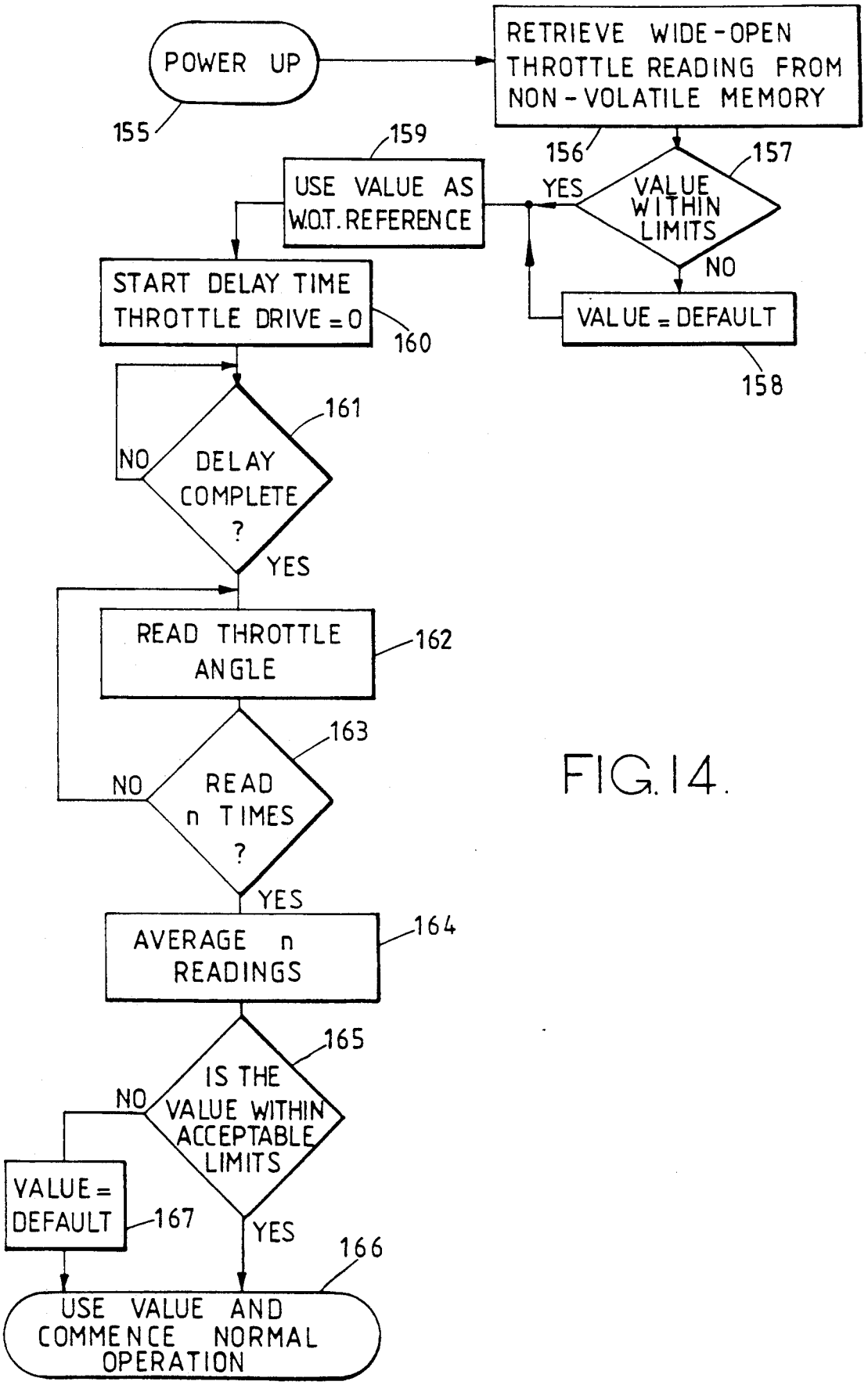
FIG. 14 is a flow chart for illustrating operation of a sixth embodiment of the invention using hardware of the type shown in FIG. 12.

The flow chart shown in FIG. 14 shows the "power-up sequence" performed by the micro-computer 126 when the ignition switch 131 is turned on but prior to starting the engine (155). At 156, the wide-open throttle position determined in the step 149 is retrieved from the memory 129 and, at 157 is compared with predetermined limit values. If the value is outside the limit values, then the measured value is replaced at 158 with a default value. The actual value or the default value is then used during further operation of the engine throttle control system as the "wide open throttle reference" (159).

The micro-computer 126 supplies signals for ensuring that the throttle 120 is closed and starts a delay time at 160. When the delay time is complete (161), the throttle angle is read at 162 inside a loop controlled by a comparison step 163 until the throttle angle determined by the position sensor 123 has been read n times. The average of these readings is taken at 164 and checked at 165 so as to ascertain whether the average value is within acceptable limits. If so, then this value is used to represent the throttle closed position and normal operation begins at 166. If the average value is outside the acceptable limits, then a default value is substituted at 167 and this is used during further operation of the system at 166.

It is thus possible to provide a reference value for the throttle-closed position. Thus, each time the engine has been stopped and then started again, the micro-computer 26 has up-dated values for the fully open and fully closed throttle positions as determined by the position sensor 123. These values are used during normal operation of the engine throttle control system, so that any drifts are compensated for.

Figure 15:
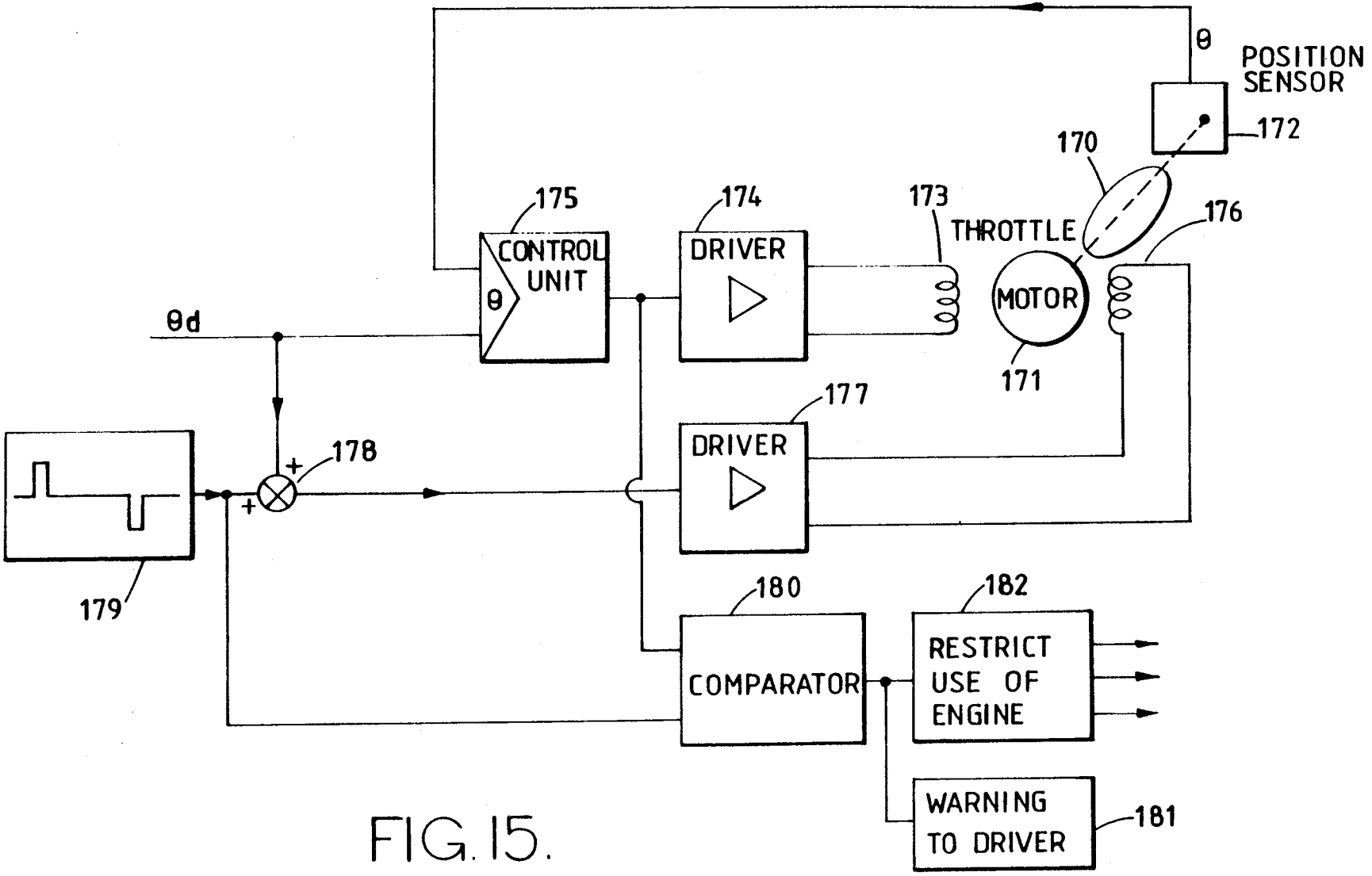
FIG. 15 is a block schematic diagram of an engine throttle control system constituting a seventh embodiment of the invention.

FIG. 15 shows an arrangement for driving a butterfly throttle 170 by a modified type of motor 171 connected to a position sensor 172 whose output signal $\theta$ represents the angular position of the throttle 170. This arrangement may be used with any of the previously described systems. The motor 171 has a first winding 173 connected to the output of a drive amplifier 174 whose input is connected to a control unit 175. The control unit 175 has a first input which receives a throttle demand signal $\theta_d$ and a second input which receives the throttle angle position signal $\theta$ from the sensor 172.

The control unit 175 compares the demanded throttle angle $\theta_d$ with the actual throttle angle 8 and supplies an error signal to the amplifier 174, which drives the winding 173 so as to cause the motor 171 to reduce the error signal and position the throttle 170 at the demanded position. These parts therefore provide closed loop servo control of the throttle 170.

The motor 171 has a second winding 176 connected to the output of a drive amplifier 177 whose input is connected to the output of a summer 178. The summer 178 has a first input connected to receive the demanded throttle position signal $\theta$ and a second input connected to the output of a signal generator 179 which supplies a sequence of first and second signals. Each first signal comprises a pulse of predetermined duration and of polarity such as to tend to close the throttle 170 and alternates with each second signal, which comprises a pulse of predetermined duration and of polarity which tends to open the throttle 170. A space of predetermined length occurs between each consecutive pair of pulses.

The winding 176, the amplifier 177, and the summer 178 act, during the spaces between pulses, as an open loop throttle control system.

A comparator 180 compares the output signal of the control unit 175 with a predetermined acceptable range for each pulse from the signal generator 179 and, if the comparison is outside the predetermined acceptable range, supplies an output signal to a driver warning device 181 and to a block 182 for restricting use of the engine, for instance by disabling fuelling and ignition of the engine or by returning the engine to idle operation or limiting maximum engine output.

During normal operation of the system and assuming that the throttle 170 is at the demanded position, each first signal from the generator 179 is superimposed on the demand signal supplied to the amplifier 177. The amplifier 177 therefore controls the winding 176 so as to tend to close the throttle 170. Closing movement of the throttle 170 is detected by the sensor 172 as a new throttle position $\theta$ and the control unit 175 provides an error signal which, via the amplifier and the winding 173, causes the throttle 170 to return, or tend to return, to the demanded position.

The response of the control unit 175 is checked by the comparator 180 and, provided the response of the control unit 175 is within acceptable predetermined limits, no action is taken. However, if the response of the control unit 175 to the first signal is outside acceptable limits, a driver warning is given and use of the engine is restricted. Thus, the system detects the ability of the amplifier 177 and the second winding 176 to close the throttle 170, based on the response of the control unit 175.

Similarly, when a second signal is supplied by the generator 179, the amplifier 177 and the second winding 176 tend to open the throttle 170. The closed loop servo control tends to return the throttle 170 to the demanded value and the comparator 180 compares the response of the control unit 175 with predetermined limits in order to check the capability of the closed loop servo to control the throttle 170. If the response of the control unit 175 is within predetermined acceptable limits, no action is taken. However, if the response is outside these limits, then the same action is taken as described hereinbefore in respect of the first signal.

The system therefore provides two substantially independent channels for controlling the throttle 170 and, in particular, for returning the throttle to the closed or idle position Any fault in either independent system which might prevent one of the systems from closing the throttle is detected, allowing remedial action to be taken before complete failure of the whole system which might prevent closing of the throttle.

Figure 16:
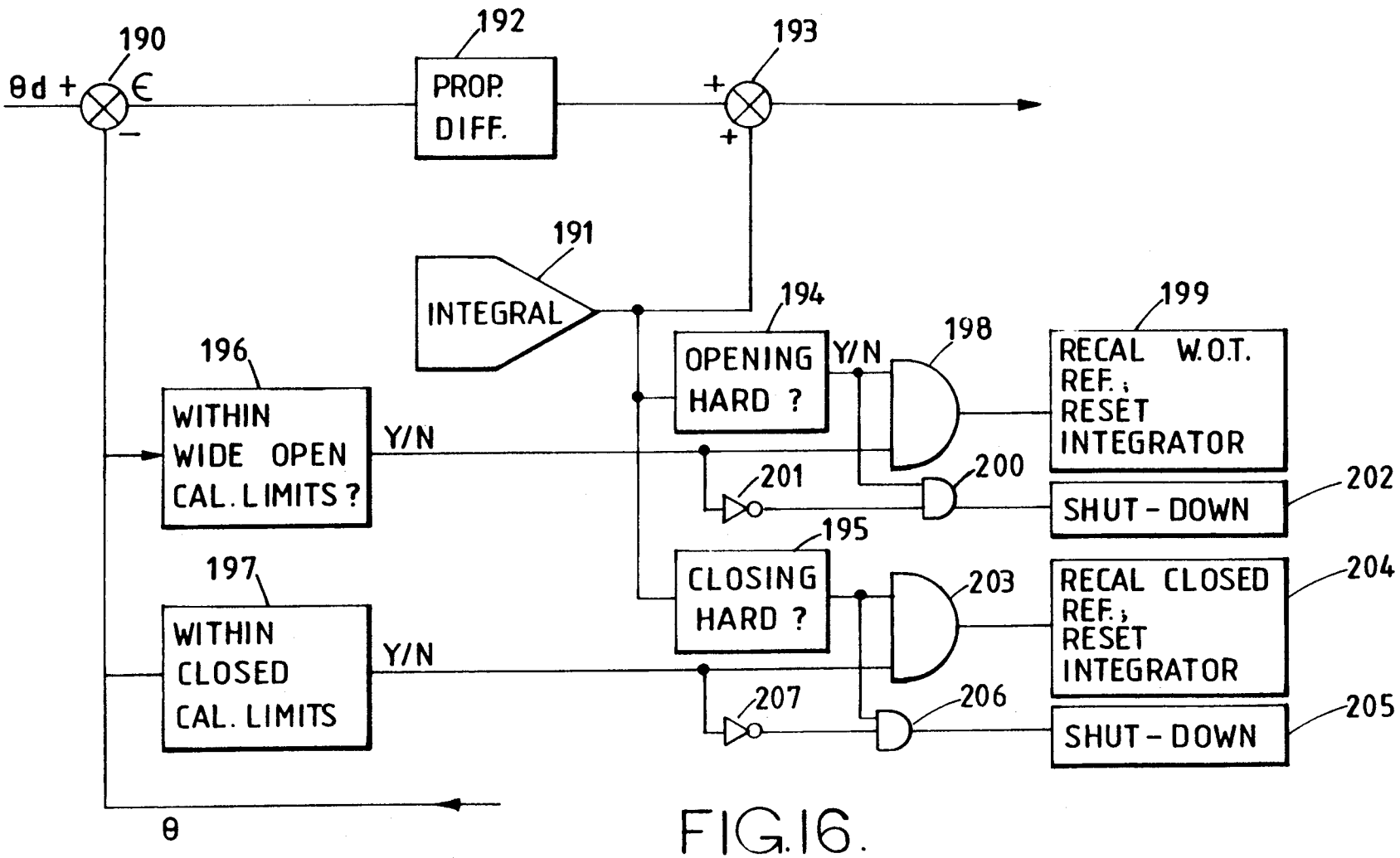
FIG. 16 is a block schematic diagram of an engine throttle control system constituting an eighth embodiment of the invention.

The system shown in FIG. 16 illustrates a possible modification to the arrangement shown in FIG. 7. FIG. 16 shows the relevant parts of a closed loop servo control system for controlling an engine throttle; the motor, the throttle, and the throttle position sensor have not been shown.

A subtracter 190 forms an error signal $\epsilon$ by subtracting the throttle position signal $\theta$ from the demanded throttle position $\theta_d$. The error signal is supplied to a control unit having a transfer characteristic which is mixture of an integral term shown at 191 and one or more non-integral terms (proportional or differential or both) shown at 192. The outputs from 191 and 192 are summed in a summer 193 whose output drives the motor.

The output of the integral characteristic circuit 191 is supplied to a first detector 194 for detecting whether the throttle is being driven hard open and to the input of a second detector 195 for detecting when the throttle is being driven hard closed.

The position signal $\theta$ is supplied to a detector 196, which detects whether the position signal is within the wide open calibration limit, and to a detector 197, which detects whether the position signal is within a closed calibration limit. The outputs of the detectors 194 and 196 are supplied to the inputs of an AND gate 198, whose output is connected to a circuit 199 for recalibrating the wide open throttle reference and resetting an integrator in the circuit 191. Thus, whenever the throttle is being driven hard open and the throttle position is within an acceptable range of values for the wide open throttle position, the circuit 199 recalibrates the wide open position and resets the integrator.

An AND gate 200 has a first input connected to the output of the detector 194 and a second input connected to the output of an inverter 201 whose input is connected to the detector 196. The output of the gate 200 is connected to a shut down circuit 202. Thus, whenever the throttle is being driven hard open but the throttle position is not within acceptable wide open calibration limits, the shut down circuit 202 causes the engine to be shut down or returned to idle operation, possibly with a warning indication for a driver.

An AND gate 203 has a first input connected to the output of the detector 195 and a second input connected to the output of the detector 197. The output of the gate 203 is connected to circuit 204 for recalibrating the closed throttle reference and for resetting the integrator. A shut down circuit 205, similar to the shut down circuit 202, is connected to the output of an AND gate 206 having a first input connected to the output of the detector 195 and a second input connected to the output of an inverter 207 whose input is connected to the output of the detector 197.

Thus, when the throttle is being driven hard closed and the throttle position is within acceptable closed calibration limits, the closed reference throttle position is recalibrated and the integrator is reset. However, when the throttle is being closed hard and its position is not within the calibration limits, the engine is shut down as described before.

It is thus possible to detect when a motor is driving the throttle hard against an obstruction and is therefore failing to respond correctly to the demanded throttle signal $\theta_d$.

We claim:

1. An engine throttle control system for controlling a motor for actuating an engine throttle, said system comprising detecting means for detecting when a signal of said control system is outside a range of acceptable values;

a control circuit for supplying a control signal for controlling the motor, said detecting means being arranged to detect when a value of the control signal is outside the range of acceptable values;

a servo control loop including said control circuit, said detecting means being arranged to detect when a level of power supplied to the motor exceeds a maximum expected power value, in which said servo control loop comprises a plurality of parallel control elements including an integral control element, producing an integral output signal, said detecting means being arranged to compare the integral output signal with the maximum expected power level.

2. A system as claimed in claim 1, further comprising comparing means for comparing the integral output signal with at least one throttle position limit value and recalibrating means for recalibrating at least one stored throttle position reference limit value when, for a predetermined number of times, the at least one throttle position limit value is exceeded and a throttle position is within at least one predetermined throttle position recalibration range.

* * * * *